United States Patent [19]

Yellen

[11] 4,101,128

[45] Jul. 18, 1978

[54] PRACTICE TENNIS DEVICE

[76] Inventor: Robert Yellen, 2201-B NE. 39th St., Lighthouse Point, Fla. 33064

[21] Appl. No.: 770,382

[22] Filed: Feb. 22, 1977

[51] Int. Cl.[2] ..... A63B 67/18

[52] U.S. Cl. ..... 273/106 A; 273/29 A

[58] Field of Search ..... 273/29 R, 29 A, 106 A, 273/33, 208, 209, 95 R

[56] References Cited

U.S. PATENT DOCUMENTS

| | | | |
|---|---|---|---|
| 832,819 | 10/1906 | Singleton et al. | 273/106 A |
| 1,393,408 | 10/1921 | Tenney | 273/106 A |

FOREIGN PATENT DOCUMENTS

| | | | |
|---|---|---|---|
| 216,536 | 7/1958 | Australia | 273/106 A |
| 2,913 of | 1889 | United Kingdom | 273/106 A |
| 20,247 of | 1907 | United Kingdom | 273/200 R |

*Primary Examiner*—Richard C. Pinkham
*Assistant Examiner*—T. Brown
*Attorney, Agent, or Firm*—Malin & Haley

[57] ABSTRACT

A practice tennis device, whose weight is preferably equal to the weight of a regulation tennis ball, that includes a section of a tennis ball or a sectioned tennis ball with a flight cone means equal in weight to the removed section of the tennis ball. The weight and feel by the players using tennis racquets in contact with the practice tennis device is very similar to a conventional tennis ball while the aerodynamic qualities are similar to a badminton shuttlecock thereby allowing a user to practice tennis in a restricted practice area.

9 Claims, 3 Drawing Figures

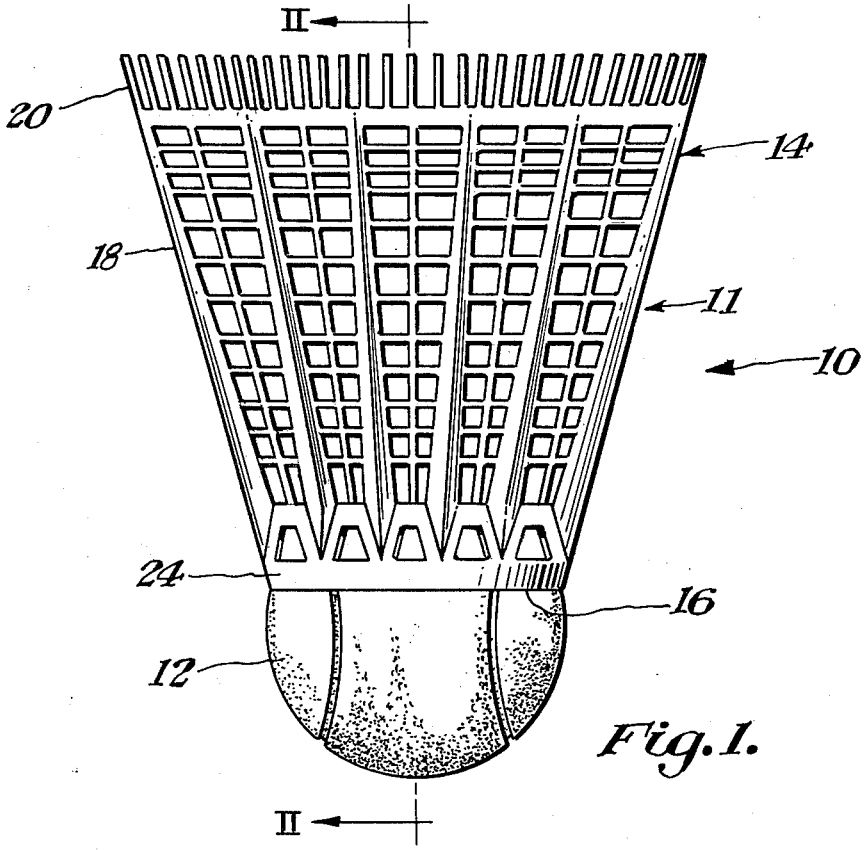
Fig. 1.
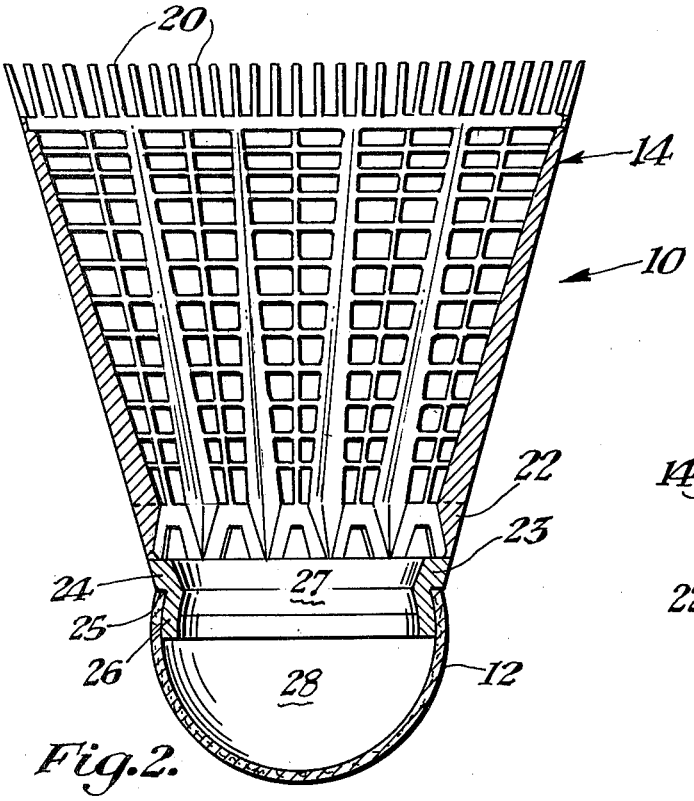
Fig. 2.
Fig. 3.
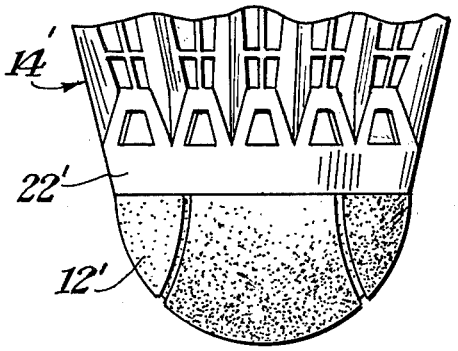

PRACTICE TENNIS DEVICE

BACKGROUND OF THE INVENTION

In the past, shuttlecocks consisting of a plastic striking cap and a skirt or cone have been designed and used, such devices were weighted and aerodynamically designed for movement over a particular distance and at particular speeds during use in a particular game such as badminton. Such devices were made without regard to the weight or aerodynamic design in relation to any other game projectiles such as tennis balls. The present invention is somewhat similar to a badminton birdie but differing in concept and design in order to maintain a preferred weight of a regulation tennis ball and to provide a preferred duplication of response, except for distance, when a player hits the practice tennis device with a tennis racquet. Other types of shuttlecocks using a whole ball such as U.S. Pat. No. 1,011,856 are also know.

SUMMARY OF THE INVENTION

This practice tennis device invention relates to an actual sectioned tennis ball with a flight steadying and slowing cone means connected thereto while maintaining a total weight of a tennis ball and providing the user of a tennis racquet with the same feel and sound of striking a conventional tennis ball. The practice tennis device allows the game of tennis to be practiced in a player's own backyard, a confined area.

The practice tennis device includes a portion of a tennis ball and an attached cone means or winged means. The cone means includes a stabilizing skirt or a stabilizing skirt and an intermediate member. The stabilizing skirt is connected to a section of a tennis ball. The intermediate member may be positioned between the cone means and the section of a tennis ball. The used section or portion of the tennis ball is preferably a portion of a pressureless tennis ball which has been cut along a chord at approximately two-thirds the diameter of the sphere with the smaller section removed. The ball or sphere may be cut in half for use on two separate practice tennis devices. The removed section one-third of the diameter is then replaced by the cone means which is equivalent in weight to the said removed section of the tennis ball. The cone means is fixed to sectioned tennis ball. The cone means and the sectioned tennis ball may be sealed to provide a pressurized or pneumatic spheral interior or chamber in the sectioned tennis ball when a pressurized tennis ball is used. The cone means and the sectioned tennis ball need not be sealed when a section of a non-pressurized tennis ball is used.

It is an object of this invention to provide a practice tennis ball device with a section of a tennis ball positioned for striking and a cone means that is preferably equal in weight to the removed section of the tennis ball for aerodynamic purposes.

It is an object of this invention to provide a new and improved structure for practicing tennis with tennis racquets in a confined practice area.

It is a further object of this invention to provide a shuttlecock type device as a practice tennis device having the same feel and sound of a regular tennis ball when hit by a tennis racquet.

In accordance with these and other objects which will be apparent hereinafter, the instant invention will now be described with particular reference to the accompanying drawings.

BRIEF DESCRIPTION OF THE DRAWINGS

The present invention is herein described and illustrated with respect to particular embodiments thereof, as illustrated in the accompanying drawings wherein:

FIG. 1 is a side elevation of one form of the practice tennis device;

FIG. 2 is a cross section side view of the practice tennis device as shown in FIG. 1 taken along lines II—II; and FIG. 3 is a side view partially cutaway of another embodiment of a practice tennis device.

DESCRIPTION OF THE PREFERRED EMBODIMENT

Considering now the present invention in some detail and referring to the drawing, it is noted that in FIGS. 1 and 2 there is illustrated one embodiment of the practice tennis device 10 consisting of a section or portion of a tennis ball 12 and an attached cone means, generally designated by numeral 11. The cone means or winged means includes a stabilizing skirt 14 connected together by an intermediate member 24. The section of the tennis ball 12 is preferably a portion of a pressureless tennis ball which has been cut along a chord 16 at approximately two-thirds the diameter of the sphere. The smaller section is removed. The tennis ball having a diameter of approximately 2⅝ inches may be cut along a cord between two-thirds the diameter of the tennis ball to one-half the diameter of the tennis ball. The ball used in this invention preferably is to United States Tennis Association standards for USTA tournaments, although non-USTA approved balls may be used.

Also balls of diameters 1/64 inch smaller or larger may be used. Diameters ½ inch smaller or larger appear to be too large or too small. When the tennis ball is cut at one-half the diameter, as shown in FIG. 3, both halves of the tennis ball may be used on separate practice tennis devices. The removed section is then replaced by the cord means 11 which is equivalent in weight to the said removed section of the tennis ball. In FIGS. 1 and 2 the cord means includes the stabilizing skirt 14 and intermediate member 24. In FIG. 3 the cord means includes only the stabilizing skirt 14.

The stabilizing skirt 14 shown in FIGS. 1 and 2 includes the base 22, ribs 18 and end portions 20. The stabilizing skirt can be molded from materials such as used in the production of badminton shuttlecocks, such as polyethylene. The stabilizing skirt 14 has an array of ribs 18 which extend from the wider open end 20 at the upper end of FIGS. 1 and 2 to narrow base 22. The terminal end 23 of the base or base portion 22 is connected to the top of intermediate member 24.

The lower end of the intermediate member has an outside diameter equal to the outside diameter of the tennis ball 12 at the sectioned perimeter. The intermediate member 24 also has a rim 25 defined by flange portion 26. The distal end of the flange portion 26 is remote from the rim 25 and has a smaller outside diameter than the outside diameter of rim 25. The rim 25 and flange portion 26 allows the stabilizing skirt 14 and the intermediate portion to be firmly secured to the cut edge and a portion of the inner surface of the section of the tennis ball 12. The stabilizing skirt is fixed to the intermediate member which is fixed in the tennis ball. The intermediate member may be open at 27 when a non-pressurized tennis ball sections are used and may be sealed closed by a lid member to provide vacuum in the ball at 28 when pressurized tennis ball sections are used.

The weight, feel and sound of the present invention is of prime importance with regard to the use of the practice tennis device with a tennis racquet for practice purposes, the actual diameter of portion 20 and for the height and other dimensional sizes of the skirt of the practice tennis device can vary to provide slower or faster play. Where the weight of the present invention is limited to approximately 2 ounces, the weight of an official tennis ball per United States Tennis Association standards, the overall length of the shuttlecock may vary from 5 inches to 6.5 inches, while the diameter of the wide open end 20 of the stabilizing skirt may be from 4 inches to 5 inches without drastically changing the aerodynamic qualities of the practice tennis device.

Ball portion 12 may be one-half of a spherical tennis ball as shown in FIG. 3. The stabilizing skirt 14 may be directly connected to the tennis ball, especially when the ball is cut in half.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A practice tennis device comprising:

a first portion of a regulation spherical tennis ball of at least one-half of the spherical tennis ball, and a cone means generally equal to the weight of the other portion of the tennis ball severed from said first portion, said cone means connected to said first portion of said spherical tennis ball providing a tennis practice device with a weight generally equal to the weight of a regulation spherical tennis ball providing a player with the same feel when a tennis racquet hits the device as when the tennis racquet hits a regulation tennis ball and said cone means including a winged means for stabilizing said device in flight.

2. A practice tennis device as set forth in claim 1 wherein:

said first portion is a portion of a pressureless tennis ball.

3. A practice tennis device as set forth in claim 1 wherein:

said first portion is a portion of a pressurized tennis ball, said cone means is sealed to said first portion to provide a pressurizable chamber in said first portion of said spherical tennis ball, and said chamber pressurized above atmospheric pressure.

4. A shuttlecock as set forth in claim 1 wherin, said winged means including a stabilizing skirt means.

5. A shuttlecock as set forth in claim 1 wherein, said winged means including a stabilizing skirt means and an intermediate portion connected to said skirt means, said intermediate portion connected to said first portion.

6. A tennis shuttlecock as set forth in claim 4 wherein:

said stabilizing skirt means has an array of ribs extending from a base portion to a remote portion spaced from said first portion.

7. A stabilizing skirt means as set forth in claim 6 wherein:

said base includes an extended tapered flange.

8. A tennis shuttlecock as set forth in claim 4 wherein:

said stabilizing skirt means is firmly secured to said first portion.

9. A tennis shuttlecock as set forth in claim 8 wherein:

said winged means is weighted to provide the same sound and feel as an official tennis ball when the shuttlecock is hit by a tennis racquet.

* * * * *